US009540776B2

(12) United States Patent
von Langsdorff

(10) Patent No.: US 9,540,776 B2
(45) Date of Patent: Jan. 10, 2017

(54) POLLUTANT SEQUESTERING PAVING SYSTEM

(71) Applicant: F. von Langsdorff Licensing Limited, Caledon (CA)

(72) Inventor: Harald von Langsdorff, Caledon (CA)

(73) Assignee: F. von Langsdorff Licensing Limited, Caledon (CA)

( * ) Notice: Subject to any disclaimer, the term of this patent is extended or adjusted under 35 U.S.C. 154(b) by 187 days.

(21) Appl. No.: 13/684,697

(22) Filed: Nov. 26, 2012

(65) Prior Publication Data

US 2013/0136534 A1 May 30, 2013

Related U.S. Application Data

(60) Provisional application No. 61/565,147, filed on Nov. 30, 2011.

(51) Int. Cl.
*E01C 11/22* (2006.01)

(52) U.S. Cl.
CPC ..... *E01C 11/225* (2013.01)

(58) Field of Classification Search
CPC ..... E01C 11/225
USPC ..... 404/27, 30, 28, 29, 31, 82
See application file for complete search history.

(56) References Cited

U.S. PATENT DOCUMENTS

| | | | | |
|---|---|---|---|---|
| 6,468,942 | B1 | 10/2002 | Sansalone | |
| 6,767,160 | B2 | 7/2004 | Sansalone | |
| 7,168,884 | B2 * | 1/2007 | Hart | 404/29 |
| 7,651,293 | B2 * | 1/2010 | Shaw et al. | 404/72 |
| 8,104,990 | B2 * | 1/2012 | Lowe | 404/31 |
| 8,142,101 | B2 * | 3/2012 | Kaul | 404/31 |
| 8,162,562 | B2 * | 4/2012 | Sansalone | 404/72 |
| 8,162,563 | B2 * | 4/2012 | Shaw et al. | 404/75 |
| 8,297,874 | B2 | 10/2012 | Krzyzak | |
| 2004/0067103 | A1 * | 4/2004 | Hart | 404/2 |
| 2007/0207302 | A1 * | 9/2007 | Cucitore et al. | 428/292.1 |
| 2008/0267701 | A1 * | 10/2008 | Lowe | 404/17 |
| 2009/0238646 | A1 * | 9/2009 | Sansalone | 405/45 |
| 2010/0284740 | A1 * | 11/2010 | Sawyer | E01C 3/006 404/70 |
| 2011/0064517 | A1 * | 3/2011 | Sader | 404/28 |
| 2011/0211908 | A1 * | 9/2011 | Krzyzak | 404/70 |

(Continued)

FOREIGN PATENT DOCUMENTS

| | | |
|---|---|---|
| CA | 2632959 | 6/2009 |
| JP | 2001262502 | 9/2001 |

(Continued)

OTHER PUBLICATIONS

Perry et al., "Urban Stormwater Runoff Phosphorus Loading & BMP Treatment Capability", MAFSM 5th Annual Conference, Oct. 21-23, 2009.

*Primary Examiner* — Abigail A Risic
(74) *Attorney, Agent, or Firm* — Santosh K. Chari; Blake, Cassels & Graydon LLP

(57) ABSTRACT

In one aspect, a paving system for sequestering pollutants comprises one or more layers, at least one of said layers comprising a sequestering agent, and a fluid flow restrictor. In another aspect, a method of applying a sequestering agent to a paving system comprises obtaining a sequestering agent medium; and applying the sequestering agent medium to a paving system. In another aspect, the paving system comprises a piping layer for draining fluid from the paving system.

14 Claims, 6 Drawing Sheets

(56) References Cited

U.S. PATENT DOCUMENTS

2012/0063846 A1* 3/2012 Chen et al. ..... 404/82

FOREIGN PATENT DOCUMENTS

| | | |
|---|---|---|
| JP | 2009270302 | 11/2009 |
| WO | WO02/081822 | 10/2002 |

* cited by examiner

POLLUTANT SEQUESTERING PAVING SYSTEM

CROSS REFERENCE TO RELATED APPLICATIONS

This application claims priority to U.S. Application No. 61/565,147, the entire contents of which are incorporated herein by reference.

TECHNICAL FIELD

The following relates generally to a pollutant sequestering paving system.

BACKGROUND OF THE INVENTION

Paving systems may be used for roads, pedestrian walkways, parks, and other trafficked surfaces. In typical installations, the paving system has an exposed surface layer and fluid permeable supporting underlayers to prevent fluid (e.g. water) from pooling on the surface of the exposed layer.

The exposed surface may be stones, engineered paving stones, brick, cement, etc. and a permeable filler material, such as sand or fine crushed stone can be provided between the paving elements. Supporting fluid permeable underlayers may be composed of, for example, sand, crushed stone, pebble, gravel, or rock slabs.

In many installations, a finer grain material (e.g. sand, fine crushed stone) is used in the upper-most underlayer layer and in the filler to support the paving elements.

Typically, the particle size of the supporting underlayers is smallest in the filler material and is progressively larger in each supporting underlayer. This usually allows for laying the surface layer evenly while maximizing fluid flow.

In some installations, for example, as shown in U.S. application Ser. No. 12/713,306 to Krzyzak, "Krzyzak", a mixed aggregate comprising a distribution of particle sizes is used in a single layer to provide a balance of stability and permeability. The mixed aggregate filler material may comprise sand, crushed stone, slabs of rock, or other fine particulate material.

In other installations, for example, as shown in Japanese publication number 2001262502 to Hiromitsu et. Al., hereinafter "Hiromitsu", a permeable pavement structure capable of purifying seepage water using a filter layer is disclosed. However, the purifying system provided by Hiromitsu may be expensive to implement, particularly in existing paving structures. Furthermore, the effectiveness of Hiromitsu's design is dependent on many factors over which no manner of control is provided by Hiromitsu.

It is an object of the present invention to mitigate or obviate at least one of the above disadvantages.

SUMMARY OF THE INVENTION

In one aspect, a paving system for sequestering pollutants is provided, the paving system comprising one or more layers, at least one of said layers comprising a sequestering agent; and a fluid flow restrictor.

In another aspect, a method of applying a sequestering agent to a paving system is provided, the method comprising obtaining a sequestering agent medium; and applying the sequestering agent medium to a paving system.

In yet another aspect, a paving system comprising a piping layer for draining fluid from the paving system is provided.

BRIEF DESCRIPTION OF THE DRAWINGS

Embodiments will now be described by way of example only with reference to the appended drawings wherein.

DETAILED DESCRIPTION OF THE INVENTION

Figure 1:
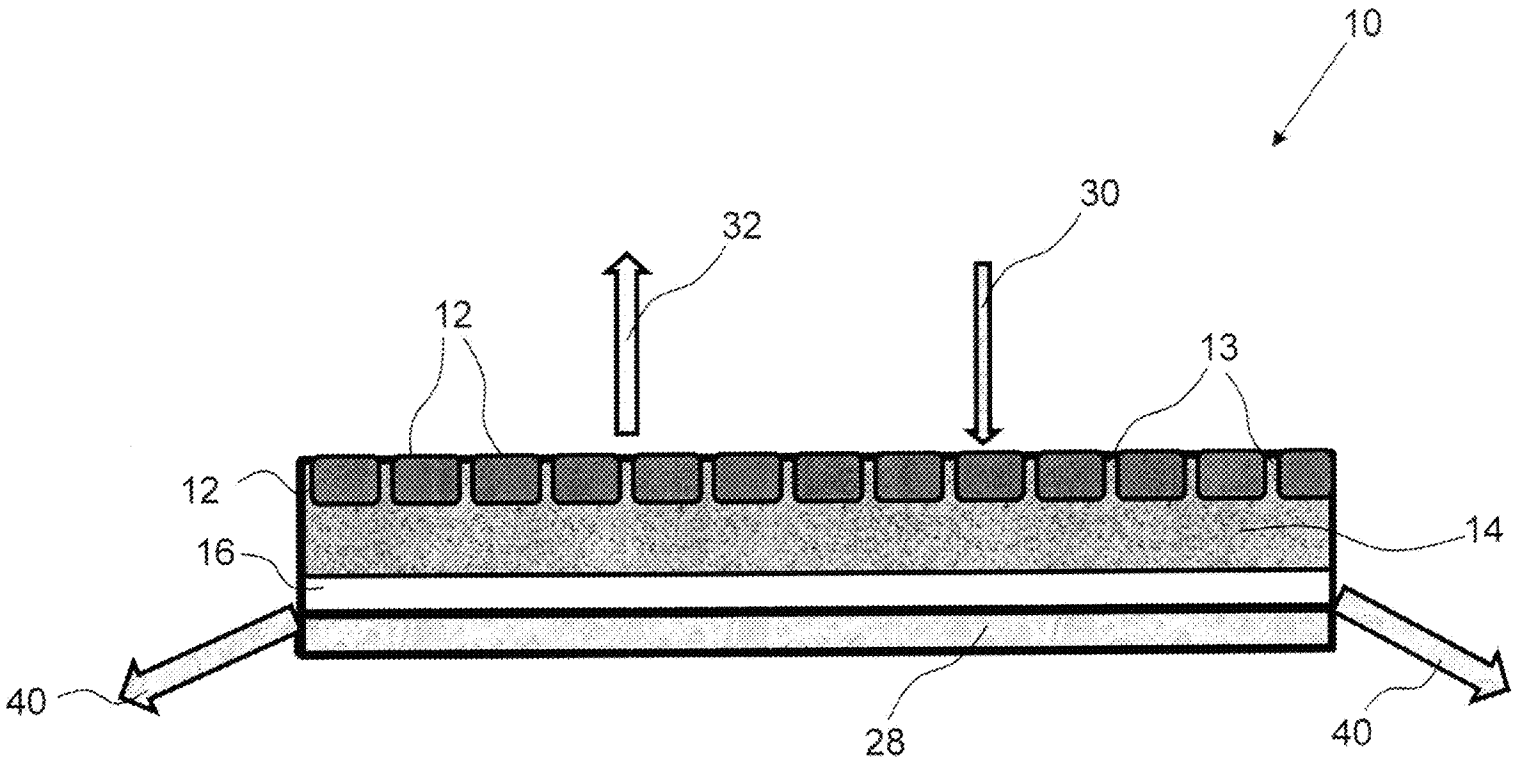
FIG. 1 is a cross sectional side view of a paving system with a piping layer.

The present invention provides a pollutant sequestering paving system. The system enables the control of fluid permeability and/or flow in the paving system to control or adjust the residence time of the fluid with a sequestering agent to generally reduce in concentration of one or more pollutants in the fluid to purify the fluid for drainage into the environment.

Paving systems may, for example, be used in areas of high traffic. Areas of high traffic may be associated with areas of higher concentration of pollutants. For example, roads for vehicular traffic are commonly subject to seepage of automotive fluids such as fuel, antifreeze and oils. Moreover, other pollutants including fertilizers, seepage from the paving stones themselves, or animal feces may be distributed along vehicular roadways at a relatively high concentration.

As mentioned above, permeable pavements may allow for fluid drainage. Fluid draining through a permeable paving system may comprise pollutants. For example, precipitation may carry organic solvents, fuel, fertilizers, lubricating oils, etc. through a paving system and into nearby groundwater. It is typically desirable to reduce the concentration and/or quantity of pollutants that may be running through the paving system prior to the pollutants entering groundwater.

The pollutant sequestering paving system comprises one or more layers. The paving system may further comprise one or more fluid flow restrictors, one or more piping layers, one or more flow control valves or any combination thereof. The paving system further comprises one or more sequestering agents each disposed on or in one or more of the foregoing components or layers of the paving system. The sequestering agents, more fully described below, generally reduce in concentration one or more pollutants in the fluid to purify the fluid for drainage into the environment.

The fluid flow restrictor restricts the flow of fluid therethrough. Preferably, the fluid flow restrictor is disposed beneath at least one component or layer of the paving system that comprises a sequestering agent. By this arrangement, fluid entering the paving system will flow through at least one component or layer of the paving system, coming into contact with a sequestering agent, prior to contacting the fluid flow restrictor. Once the fluid contacts the fluid flow restrictor, provided that a threshold amount of fluid is introduced into the paving system, the fluid will begin to build up between the upper surface of the paving system and the fluid flow restrictor, thus increasing the residence time of the fluid with the sequestering agent.

To reduce overflow of the paving system when a substantial amount of fluid is present, the paving system may comprise one or more piping layers. Preferably, the one or more piping layers may be disposed between the upper surface of the paving system and a fluid flow restrictor (or, the lower surface of the paving system where a fluid flow restrictor is not provided). The piping layer enables fluid to flow out of the paving system. When fluid building up above the fluid flow restrictor reaches the level of the piping layer, it may be diverted away from the paving system to reduce overflow.

In some implementations, it may be preferable to increase the likelihood of overflow in order to further increase the residence time of the fluid with a sequestering agent. In such implementations, the paving system may further comprise one or more overflow relief mechanisms. The overflow relief mechanisms preferably control the flow of the fluid out of the paving system. For example, the overflow relief mechanisms may be coupled to any one or more of the piping layers to control the flow of fluid out of the paving system through the piping layers.

In one aspect, the fluid flow restrictor may be formed from an impermeable sheet, a permeable membrane or other materials that can restrict the flow of a fluid. The fluid flow restrictor may extend upwardly on the sides of the paving system to create a reservoir. The reservoir may prevent or reduce unwanted drainage of fluid laterally from the paving system.

The paving system comprises one or more sequestering agents on or in one or more of the components or layers of the paving system. A sequestering agent may be applied to components of a paving system prior to construction of the paving system. For example, the sequestering agent may be provided on the surface of a paving stone, in or on a piping layer, in or on a fluid flow restrictor, or in or on any of the layers. The sequestering agent may also be mixed into an aggregate or other underlayer material at, for example, a gravel pit prior to delivering the paving system to an installation site. The sequestering agent may also be mixed into an underlayer, for example, a mixed aggregate layer comprising a variety of particle sizes during construction of the paving system. Mixing a sequestering agent into a single mixed aggregate layer requires fewer processing steps. Transport of a single mixed aggregate layer may also require less equipment than transport of a plurality of segregated materials.

The sequestering agent remediates, sequesters, catalyzes, reacts with, binds, traps or otherwise removes one or more pollutants from a fluid flowing through the paving system. The sequestering agent may remove, or reduce in concentration, one or more pollutants from a fluid. Pollutants may be unwanted chemicals, particles, or other pollutants that may permeate the paving system. The fluid may comprise, for example, water, air, another gas, an organic solvent, etc. The sequestering agent may comprise one or more chemicals or structures that can remove, or reduce in concentration, one or more pollutants. For example, the sequestering agent may comprise a selectively permeable membrane, an adsorbent, an absorbent, a catalyst, etc. The sequestering agent may adsorb one or more pollutants by binding with the pollutant or trapping the pollutant. The sequestering agent may also react with the pollutant, catalyze the pollutant or dissolve the pollutant. The sequestering agent may enable the sequestering of one or more pollutants. For example, sequestering agents comprising biomass such as certain roots and microbes may be used to sequester hydrocarbons, nitrogen and nitrates. Sequestering agents such as iron and aluminum oxide may sequester phosphates. It is to be understood that other sequestering agents may be used to sequester other pollutants, such as suspended solids, natrium chloride or sodium chloride, phenols, nitrates, chromium, chloride, phosphates, ammonium and *Escherichia coli*, for example. More than one sequestering agent can be used in the paving system or in any layer thereof. The sequestering agent may be formed from recycled materials, for example, recycled iron beams.

The time required for a sequestering agent to sequester a pollutant may depend on a plurality of factors including, for example, the chemistry and morphology of the sequestering agent, the nature of the pollutant, whether the sequestering agent is operating in an aerobic or anaerobic stage, and temperature. A sequestering agent that has been in service for an extended period of time may lose sequestering efficacy. For example, a membrane may foul (e.g. the membrane's pores may become clogged), iron particles may oxidize, the surface of adsorbents may be filled to capacity, etc.

To determine a sequestering agent's effectiveness, the residence time of a fluid with the sequestering agent should be determined. The residence time may be defined as the period of time over which the average pollutant particle in a fluid is in contact with the sequestering agent. In general, the sequestering agent is more effective with an increased residence time.

An acceptable residence time may be determined based on the chemistry, morphology, and concentration of the pollutant and the sequestering agent. For example, an acceptable residence time for a fluid comprising a certain concentration of dangerous pollutant such as an automotive fuel may be defined as the time required for the sequestering agent to sequester 95% of the fuel from the fluid. For a fluid containing a different pollutant, for example, a bacteria from livestock feces, an acceptable residence time may be defined as the time required for the sequestering agent to reduce the bacteria concentration to 25% of its original value.

In one aspect, the paving system may comprise a fluid flow restrictor that reduces the flow of fluids through or from the paving system to increase the residence time. The fluid flow restrictor may be disposed beneath at least one layer of the paving system that comprises a sequestering agent. The residence time of a fluid with a sequestering agent may be increased by reducing the flow of the fluid from the paving system, since the reduced outward flow may result in a fluid buildup in the paving system, preferably in a component or layer of the paving system comprising a sequestering agent.

As outlined above, the flow restrictor may comprise one or more membrane layers. Each membrane layer may comprise one or more membranes, which reduce the flow of fluids, thereby increasing the residence time of a polluted fluid in contact with a pollutant sequestering agent. Membrane layers preferably comprise a continuous membrane film. Membrane layers may alternatively comprise a horizontally laid grid of membrane elements which preferably overlap or are sealed to one another to reduce or eliminate leakage of fluid therebetween.

A membrane may extend to each edge of the paving system to have an area substantially equal to the surface area of the paving system. The membrane may be disposed beneath and substantially parallel to the surface layer of the paving system. A membrane layer may alternatively extend beyond the edges of the paving system and upwards towards the surface layer, forming a permeable reservoir around at least some of the layers of the paving system, to reduce flow out of the paving system laterally.

In another aspect, the paving system may comprise a piping layer comprising one or more pipes operable to receive fluids flowing in the paving system and divert such fluids from the paving system, to reduce overflow in the paving system.

The piping layer may be disposed substantially horizontally. The piping layer may be disposed at a predetermined distance from the upper surface of the paving system or a predetermined distance of the lower surface of the paving system. Preferably, at least the portion of the paving system disposed beneath the piping layer is provided with one or more sequestering agents.

The piping layer may alternatively be disposed substantially vertically or at any other angle or combination of angles (e.g., the piping layer may be a three-dimensional grid).

The piping layer may enable at least some, but preferably most, of the fluid approaching from above the piping layer to flow beneath the piping layer. Thus, a substantial amount of the fluid flows to the sequestering agent prior to being removed from the paving system by the piping layer.

A paving system with a piping layer may optionally comprise a fluid flow restrictor. The fluid flow restrictor is preferably disposed beneath the piping layer. In this implementation, fluid flowing past the piping layer from above will reach the fluid flow restrictor beneath the piping layer and build up in the paving system. When the fluid reaches the level of the piping layer, it may be removed from the paving system to reduce overflow of the paving system.

The piping layer preferably is spaced apart to enable the fluid to flow past the piping layer from above. However, in some embodiments, the piping layer may be spaced substantially continuous (e.g., in contact) while enabling fluid to flow past the piping layer (for example, by providing the piping layer with apertures).

The piping layer may comprise one or more apertures. The apertures may, for example, be perforations. The apertures may be disposed about the piping layer or on any one or more surface of the piping layer. For example, the apertures may be disposed uniformly along the upper, lower and lateral sides of the piping layer, or along just the bottom of the piping layer, or the bottom and sides of the piping layer. It will be appreciated that the apertures may be disposed about the piping layer in other arrangements.

The apertures enable fluid flow through the piping layer.

For example, a horizontally disposed spaced apart piping layer may comprise one or more apertures on its lower side. Fluid flowing from above the piping layer generally flows past the piping layer since there are no apertures on its upper side. When fluid builds up to the piping layer, it may ingress the piping layer on its lower side and be drained.

In another example, a horizontally disposed spaced apart piping layer may comprise one or more apertures on its upper side. Fluid flowing from above the piping layer generally flows past the piping layer since they are spaced apart. Only a minority of the fluid flows into the piping layer at this time. When fluid builds up to the piping layer, it may ingress the piping layer on its upper side and be drained.

In another example, a horizontally disposed substantially continuous piping layer may comprise apertures on its upper and lower sides. Fluid flowing from above the piping layer generally flows through the piping layer via the apertures When fluid builds up to the piping layer, it may ingress the piping layer on its lower side and be drained.

In another example, a vertically disposed piping layer may comprise one or more apertures on its sides or at an end thereof. When fluid builds up to the apertures, it may it may ingress the piping layer and be drained The piping system thereby enables the residence time of a polluted fluid with a pollutant sequestering agent to be increased with a reduced risk of overflow.

The piping layer may comprise pipes of various materials including steel, concrete, polymer, and composites. The pipes in the piping layer may be laid out substantially horizontally. The pipes may comprise an opening at least at one end thereof at a predetermined distance from the fluid flow restrictor and/or from the surface and/or from any particular layer. The opening may be disposed within or coupled to the ground or a drainage column. As fluid accumulates in the pipes, it may be directed by the pipes to the opening and begin to drain into the ground or drainage column.

Substantially horizontal pipes, which may nevertheless be disposed at a sufficient angle to provide drainage, may carry fluid to a nearby pipe or to a drainage column which may remove fluid from the paving system. The pipes in the piping layer may be also be substantially vertical, or may be disposed in other orientations.

The paving elements are disposed in an arrangement that defines a perimeter. The underlayer may extend beyond any of the edges defined by the perimeter to receive fluid that may flow over or beyond the edges of any paving element disposed along the perimeter. In a paving system with a single paving element, for example, an asphalt-paved road, the paving element may be cambered to increase the flow of fluids off the surface of the pavement and over the lateral edges of the pavement. The underlayer may extend beyond these edges of the pavement such that any fluid flowing off the edges of the pavement flows into the underlayer. The fluid flow restrictor may extend beyond the edges of the underlayer.

The paving system may comprise an overflow relief mechanism. The overflow relief mechanism may be in communication with one or more of the one or more piping layers. The overflow relief mechanism may comprise a drainage column comprising a valve. Adjusting the valve may enable the adjustment of the fluid level in the paving system, which can increase or decrease the residence time of the fluid with the sequestering agent.

The sequestering agent may be applied to components or layers in various forms, for example, powder form, dry particulate form, in monolithic form, etc. Additionally, the particle size of the sequestering agent may vary from nanoparticle sizes to large monoliths. The sequestering agent may also be in liquid form. A particulate sequestering agent may be suspended in a liquid to form a sequestering agent medium such as a suspension, a solution, or a liquid-suspended particulate. The sequestering agent medium may comprise a surfactant to prevent agglomeration of the sequestering agent.

A sequestering agent medium may be applied to a paving system as a liquid, for example, in the form of a spray. In an already installed paving system, for example, the spray may be applied to the surface layer of the paving system. The sequestering agent medium may permeate the paving system. After permeating the system, the liquid component of the medium may evaporate or drain, leaving the sequestering agent in the paving system. For example, evaporation of the liquid component may leave the sequestering agent intermixed in one or more of the layers. The liquid component may also be physically separated from the sequestering agent, for example, by a filter membrane. The liquid component of the medium may be chosen to be immiscible with water to avoid the sequestering agents being suspended by precipitation.

An advantage of applying the sequestering agent to the paving system via the surface layer is that existing paving systems may be provided with a sequestering agent without the need to remove paving elements or dig through the surface layer. Furthermore, paving systems comprising depleted sequestering agents may be provided with undepleted or more effective sequestering agents. For example, an undepleted sequestering agent may be applied to a paving system having a depleted sequestering agent. A sequestering agent may also be applied to a system that did not previously comprise that sequestering agent. A sequestering agent may also be provided to components of a paving system prior to installation of the paving system.

By applying a sequestering agent as a suspension or particulate, the sequestering agent can be sprayed or otherwise applied to the top surface of a paving system and permeate one or more underlayers, and one or more fluid flow restrictors. At least a percentage of the sequestering agent may settle in the underlayers to come into contact with polluted fluids. Sequestering agent suspensions and particulates may settle in the same locations as liquids, therefore areas of highest sequestering agent concentration may advantageously coincide with areas of high pollutant concentration.

Turning to FIG. 1, a pollutant sequestering paving system is shown. The paving system 10 comprises a plurality of paving elements 12 forming a surface layer, a fluid permeable particulate underlayer 14 disposed beneath and supporting the paving elements 12, and a piping layer 16 disposed beneath the underlayer 14. A fluid permeable filler material 13 may be disposed in the interstices between the paving elements 12. The filler material 13 may restrain the paving elements 12 from lateral movement. The underlayer 14 may comprise one or more particle sizes. For example, the underlayer 14 may comprise gravel, crushed stone and pebbles. The underlayer 14 may alternatively comprise particles of substantially uniform size.

The underlayer 14 and/or the filler material 13 may be intermixed with a pollutant sequestering agent. Any of the layers may comprise a sequestering agent. Alternatively, or in addition, the surface of paving elements 12 may comprise a pollutant sequestering agent.

The piping layer 16 comprises one or more interconnected pipes that are at least partially fluid permeable. For example, the piping layer 16 may comprise a layer of pipes each having an inner bore perforated along their undersides Having perforations on only the underside enables the pipes to receive fluid preferably from beneath rather than above. This enables the pipes to receive fluid from when the fluid level in the paving system rises to the level of the pipes (for example due to decreased flow beneath). The perforated pipes may be perforated along substantially their entire underside. The underside of the pipes in the piping layer 16 may alternately comprise perforations through only certain regions. Fluid received from the underside of the piping layer 16 is more likely to have had a higher residence time with the sequestering agent.

The piping layer 16 may comprise a pollutant sequestering agent. The underlayer 14 may comprise a pollutant sequestering agent. The bore of the pipes may comprise one or more structures comprising a sequestering agent. For example, the structures may be a monolith, a mesh, etc. The structures may provide several functions including reducing the flow rate within the pipes, providing a higher surface area for the sequestering agents, and reinforcing the mechanical properties of the piping. For example, the bore of the pipes may comprise a mesh, a filter, particulate matter, one or more monoliths, etc. It will be appreciated that a paving system comprising a piping layer may also comprise a fluid flow restrictor.

When a polluted fluid comes into contact with the paving system 10, as is shown by arrow 30, the polluted fluid permeates the filler material 13 in the interstices between the paving elements 12. The fluid may carry pollutants on the surface of the paving elements 12 and the filler material 13 into the underlayer 14. If the paving elements 12 are porous, fluid may also flow to the underlayer 14 through the paving elements 12. The fluid then permeates through the underlayer 14 and arrives in the piping layer 16. The piping layer 16 receives at least a portion of the fluid that has traversed the underlayer 14. The piping layer 14 may release the fluid at a controlled rate, for example, through the perforations in the piping. The filler material 13 and/or the underlayer 14, and/or porous paving elements 12 may also filter pollutants from a fluid.

By releasing the fluid at a controlled rate and only when the fluid reaches a predetermined level, the piping layer 16 increases the residence time between the fluid and the sequestering agent. The fluids interact with the sequestering agent below the piping layer 16 and in the piping layer 16 before being released. After being released from the piping layer 16, the fluids may have a lower pollutant concentration.

After passing through the paving system 10, fluids may flow out from the piping layer 16 and be released into the ground as shown by arrows 40. Gases, including evaporated liquids and gases produced by any chemical reaction with the sequestering agent, may rise through the piping layer 16, underlayer 14, and filler layer 13 before being released into the atmosphere as shown by arrow 32.

The permeability of the piping layer 16 may be selected to increase the residence time for a particular pollutant and/or a particular sequestering agent. For example, a piping layer 16 with relatively smaller and/or fewer perforations may increase residence time of a fluid.

At higher fluid levels, the fluid pressure in the pipes is higher, causing a greater fluid flow out of the end of one or more of the pipes, thereby preventing the paving system 10 from saturating and preventing fluid from pooling the its surface layer.

Figure 2:
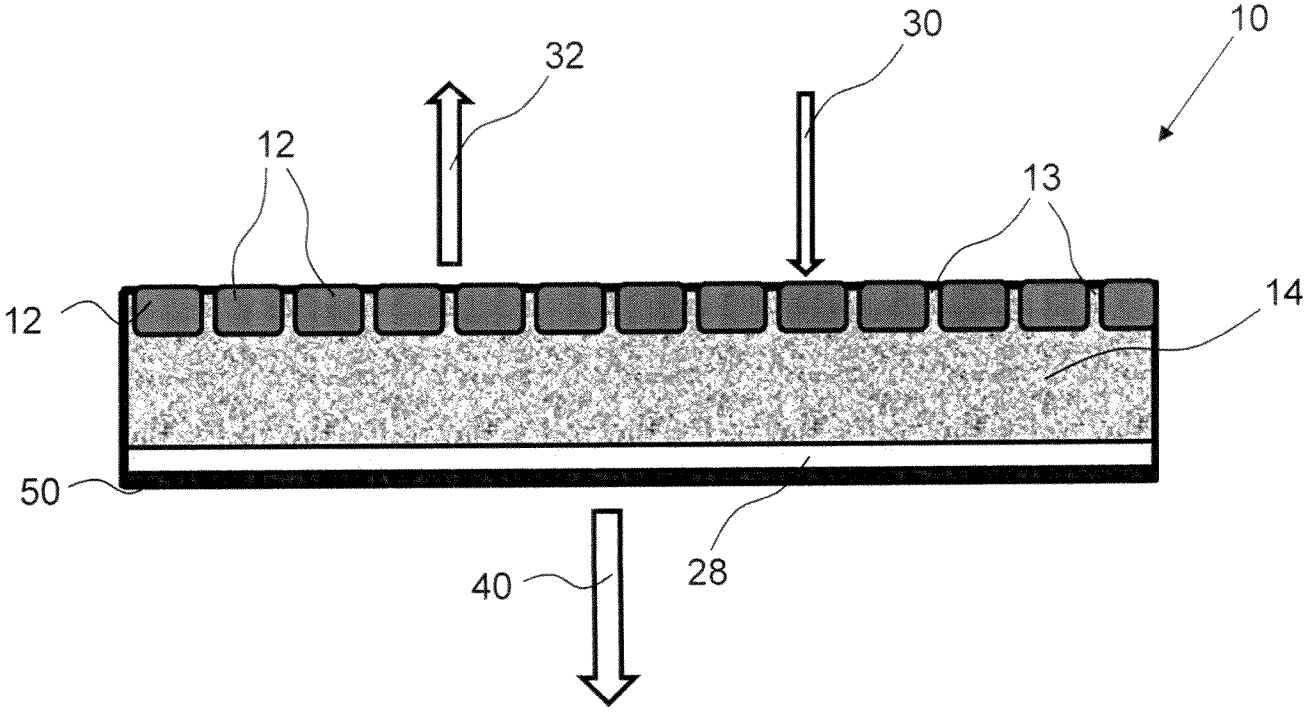
FIG. 2 is a cross sectional side view of another paving system with a membrane layer.

Turning now to FIG. 2, a paving system 10 similar to that illustrated in FIG. 1 is provided. The paving system 10 comprises paving elements 12, filler material 13, and an underlayer 14 in substantially the same arrangement as described above. However, the paving system 10 of FIG. 2 comprises a fluid flow restrictor comprising a permeable membrane 50. The membrane 50 may be provided with a pore size and surface chemistry to release fluid at a controlled rate. The membrane 50 layer may comprise a sequestering agent. The underlayer 14 may comprise a sequestering agent. For example, the sequestering agent may be intermixed in the underlayer 14.

Fluid temporarily retained by the membrane 50 has an increased residence time in the paving system 10. The residence time may be determined by the depth of the fluid above the membrane 50, herein referred to as the fluid level. In particular, the residence time of the fluid on the upper surface of the membrane 50 and in the underlayers directly above the membrane 50 and below the fluid level is most dramatically increased. As explained above, the increased residence time may enable a higher concentration of a pollutant to be removed from a fluid.

The membrane may be permeable to liquids, for example, water. The membrane may further be permeable to gases, for example, air. The membrane may further be a selectively permeable membrane that is permeable to only certain liquids or certain gases. For example, the membrane may inhibit the flow of organic molecules but allow the flow of water through its pores. The membrane may also be permeable to water vapour but not liquid water.

One advantage of using a membrane layer 50 is that a sequestering agent in the form of a powder, particulate, or a coating may be applied over the entire surface of the membrane layer 50, hence, the sequestering agent may be located at or near the pores of the membrane 50. By having a sequestering agent located at the pores of the membrane, pollutants with a shorter diffusion length may be more likely to interact with the sequestering agent. The membrane layer 50 may filter the fluid to remove pollutants.

Figure 3:
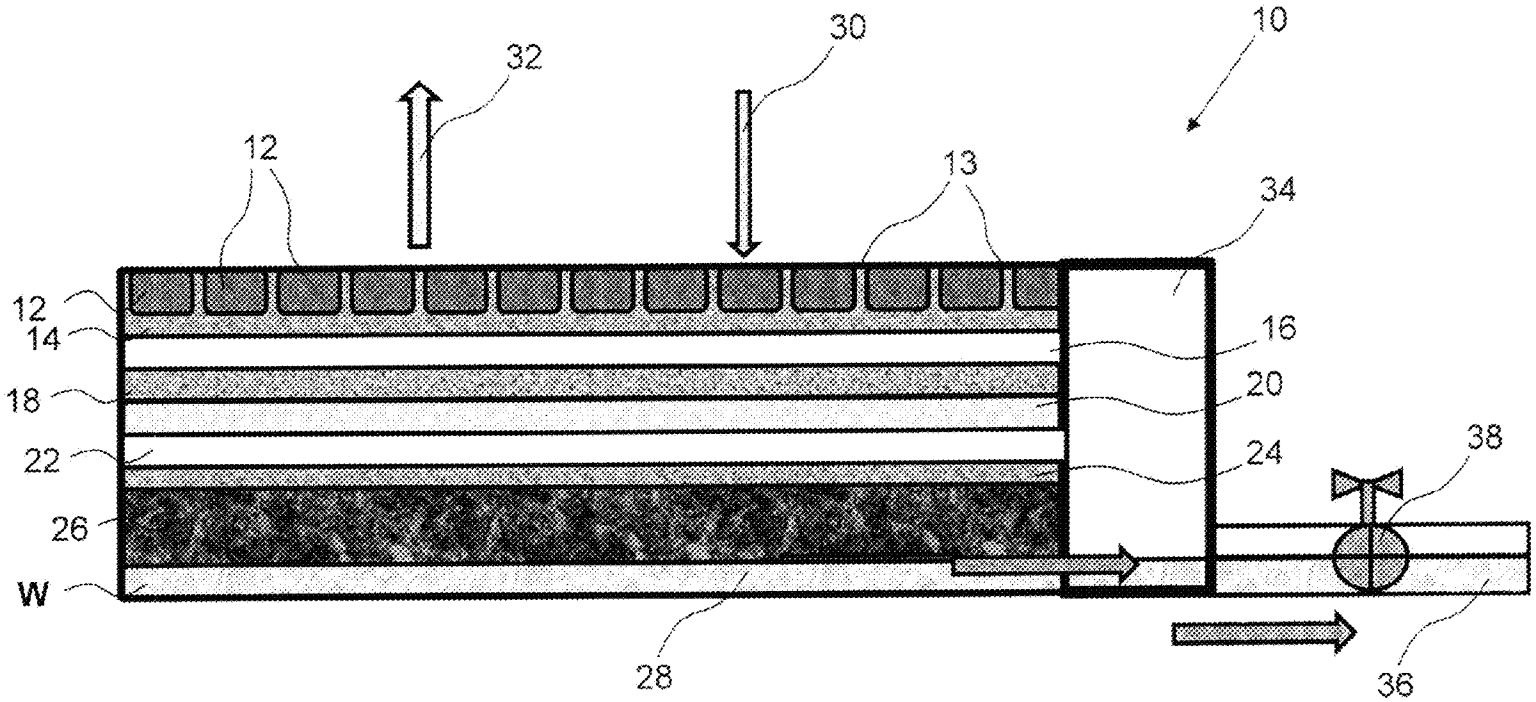
FIG. 3 is a cross sectional side view of another paving system with a perforated piping layer and an open fluid release valve.

Referring to FIG. 3, a paving system 10 comprising a plurality of layers is illustrated. The paving system comprises a layer of paving elements 12 supported by a plurality of underlayers and piping layers. The bottom-most layer is a piping layer 28 in fluidic communication with a drainage column 34. The drainage column 34 comprises an outlet 36 and a valve 38. The piping layer 28 supports an underlayer 26, which in turn, supports an underlayer 24. A second piping layer 22 is supported by underlayer 24. Underlayers 20 and 18 are supported by piping layer 22, which is also in fluidic communication with the drainage column. Above underlayer 18 is a third piping layer 16, also in fluidic communication with the drainage column 34, and the uppermost underlayer 14, which supports the paving elements 12.

A paving system comprising a plurality of separate layers may comprise a different sequestering agent or combination of sequestering agents in each layer or among the layers. A plurality of layers may also limit future repairs of the paving system 10 to a single layer or a few layers of the paving system. Such a paving system 10 may further exhibit high structural integrity.

The underlayers may comprise an aggregate mix of particle sizes or may each be of approximately uniform particle size. In paving systems with underlayers comprising unique particle sizes, underlayer 14 may have a small average particle size, and the average particle size increasing for each of underlayers 18, 20, 24, and 26. The plurality of piping layers and underlayers may enable a plurality of sequestering agents to be used, while providing each piping layer 16, 22, 28, with an appropriate residence time for the sequestering agent used in, or below, that piping layer. Each piping layer only releases fluid from the paving system 10 when the fluid level has reached the piping layer, thereby increasing the residence time in the underlayers below each piping layer.

For example, each underlayer may comprise a particular sequestering agent directed to sequestering one or a particular group of pollutants. The fluid level at each underlayer, which may be determined by the piping layers and valve 38, as described below, can be set based on the required residence time of each sequestering agent and pollutant combination.

The drainage column 34 is in communication with each of the piping layers 16, 22, and 28 to receive overflow fluid. The flow of fluid through from the drainage column 34 through the outlet 36 is allowed by the valve 38. The valve 38 may be variably adjusted to release fluid from the paving system 10 via outlet 36.

Turning the valve 38 to a more open position allows for fluid to drain from the drainage column 34, thereby lowering the fluid level W in the paving system 10. Conversely, turning the valve 38 to a more closed position allows less fluid to drain from the drainage column 34, thereby increasing the fluid level in the paving system 10. A higher fluid level corresponds to a higher residence time whereas a lower fluid level corresponds to a lower residence time.

If the fluid entering the paving system 10, as illustrated by arrow 30, is greater than the capacity of the paving system to drain, fluid may be released through the pipe layers 16, 22, and 28, the drainage column 34 allows the fluid within the paving system 10 to be released at a greater rate. For example, if significant precipitation into the paving system 10 occurs, valve 38 may be opened to allow a greater volume of fluid to drain, thereby preventing fluid from accumulating above the paving elements 12. The valve 38 as shown in FIG. 3 is in a widely open position, as is evidenced by the fluid flowing through the valve 38 and the outlet 36.

The paving system 10 may also comprise a fluid flow restrictor as previously described.

Figure 4:
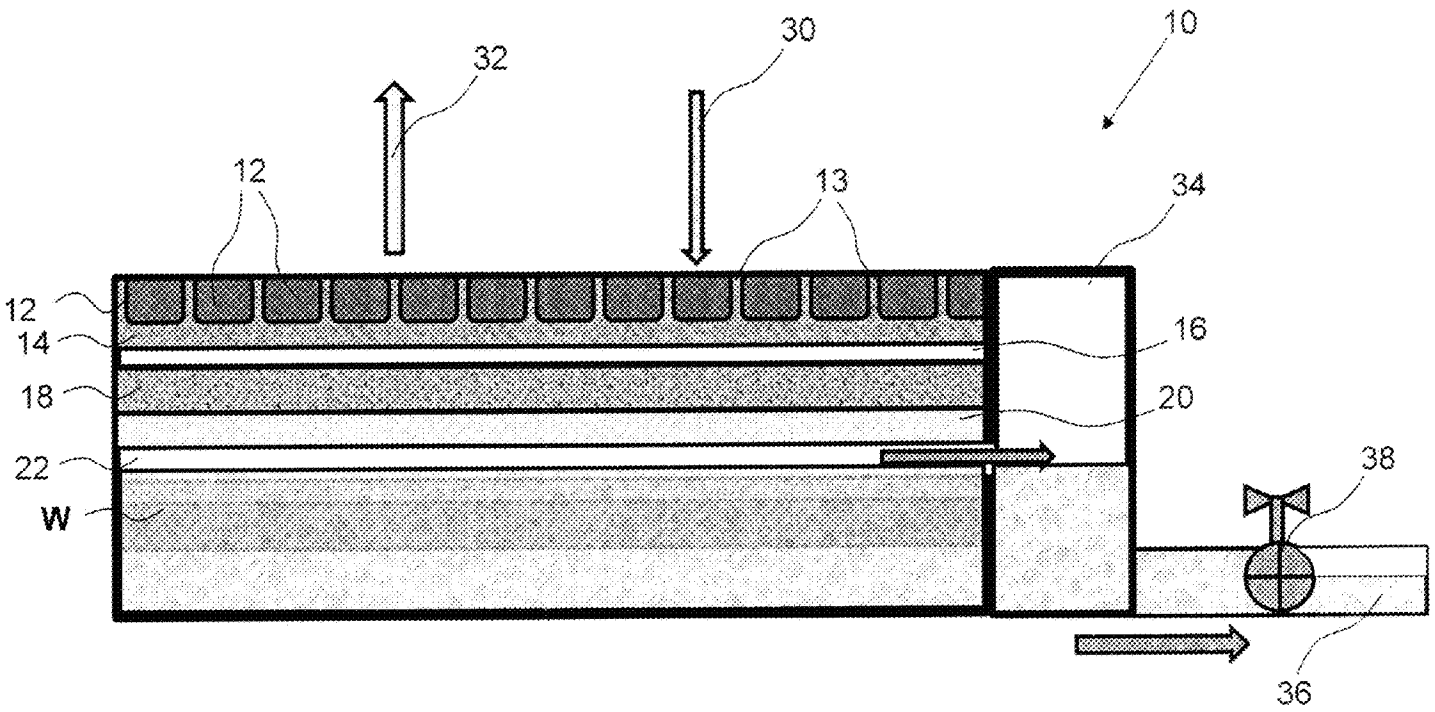
FIG. 4 is a cross sectional side view of the paving system of FIG. 3 where the fluid release valve is partially open.

Turning now to FIG. 4, the above described paving system 10 is shown with the valve 38 partially closed. As can be seen by the rising fluid level W ire the paving system 10, the residence time of the fluid in the lower layers of the paving system is increased relative to that of FIG. 3. The fluid now flows into the drainage column 34 through both piping layer 28 and piping layer 22, the latter of which is only half filled with fluid. Hence, by partially closing the valve 38, the residence time of the fluid in particular underlayers of the paving system 10 may be increased.

Figure 5:
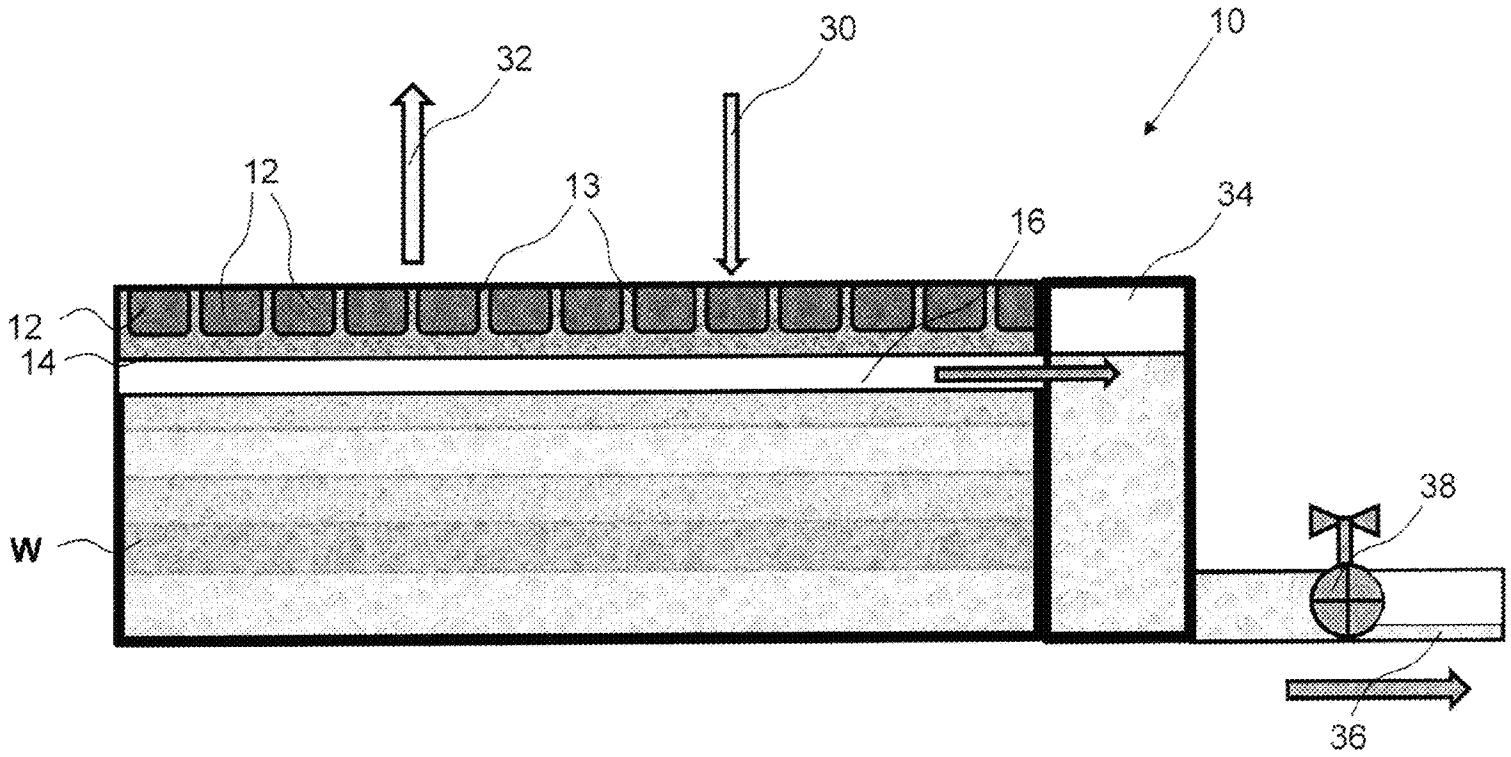
FIG. 5 is another cross sectional side view of the paving system of FIG. 3 where the fluid release valve is less open than as shown in FIG. 3.

Turning now to FIG. 5, the valve of the paving system 10 has been almost completely closed, as can be seen from the trickle of flow exiting the outlet 36. As can be seen from the fluid level W, the residence time of most of the underlayers with the possible exception of underlayer 14 and a portion of piping layer 16 has been increased, as most layers are below the fluid level W. The fluid may now flow into the drainage column 34 via piping layer 16, piping layer 22, or piping layer 28.

Underlayer 14 may also experience some increase in residence time as the capillary forces which may draw fluid into the interstices between fine particles could also bring a higher concentration of fluid into this upper-most underlayer. The effects due to capillary forces are dependent on several factors including the chemistry of the fluid and its constituent components, the surface chemistry of the particles in the underlayer 14 and the temperature of the fluid and the paving system 10.

Figure 6:
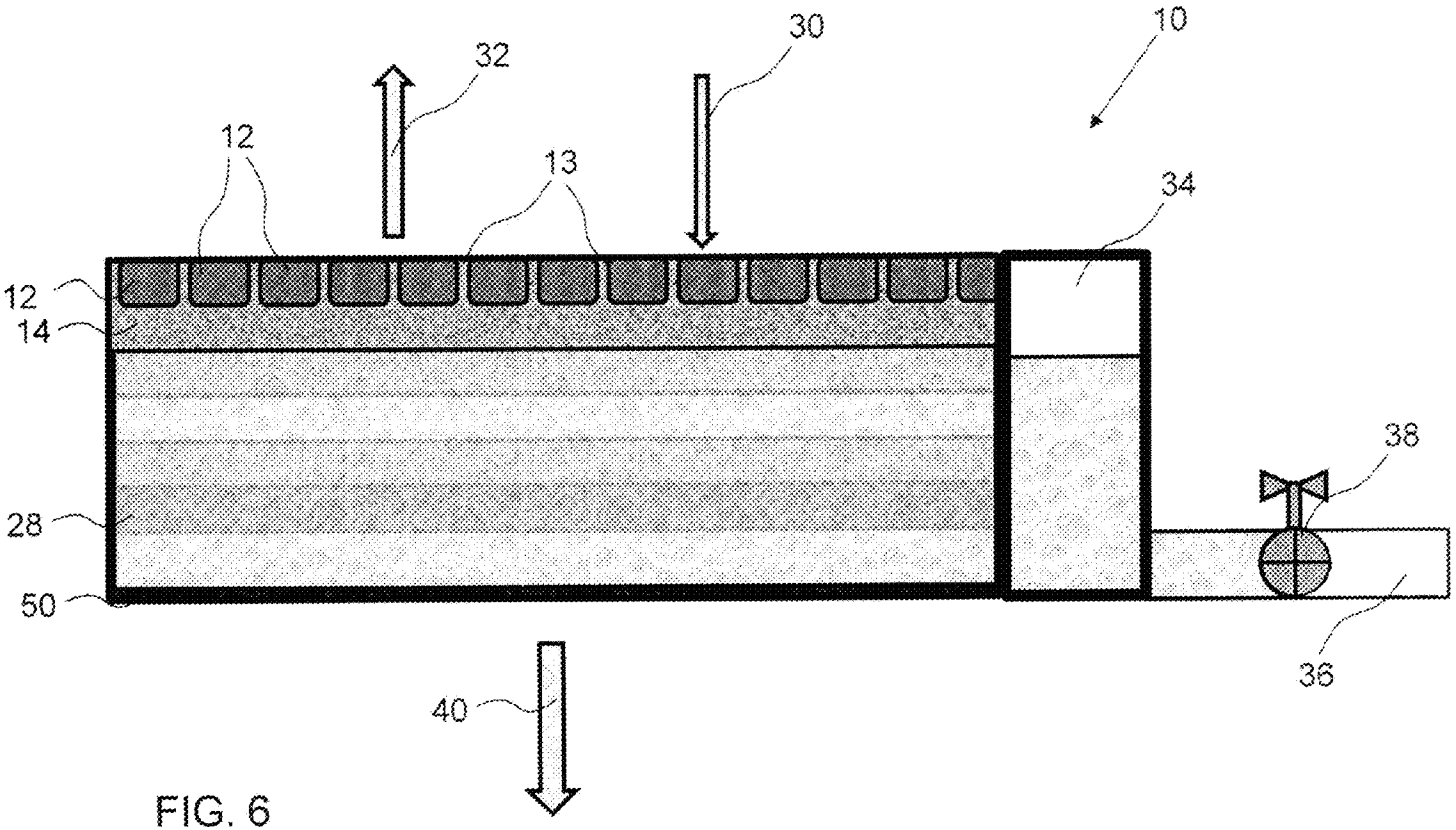
FIG. 6 is a cross sectional side view of another paving system with a membrane layer.

Referring to FIG. 6, which shows the valve 38 in the closed position, as can be seen from the lack of fluid flow out from outlet 36. The paving system 10 of FIG. 6 may comprise with a membrane 50 similar to that described in FIG. 2. The membrane 50 may be permeable, selectively permeable, or, with the use of a drainage structure such as the drainage column 34, impermeable. Drainage column 34 may have an opening at a predetermined height to receive fluid from the paving system 10 once the fluid level has reached the height of the opening. The opening in the drainage column may comprise a plurality of perforations and/or a larger opening comprising a grille or a screen.

The membrane 50 may comprise one or more layers. For example, the membrane 50 may, for example, comprise a pollutant sequestering inner layer and two protective outer layers sandwiching the inner layer. The permeability of the layers in the aforementioned example may be set depending on parameters including the nature of the fluid that is expected to flow through the paving system 10, the volume of fluid expected to flow through the paving system 10 and the residence time required between the pollutant sequestering agent and the pollutant.

The membrane 50 serves retains at least a portion of the fluid that has entered the paving system to increase the residence time of the pollutants in contact with the sequestering agents. The paving system 10 may comprise a plurality of layers of membranes 50, each layer comprising a particular sequestering agent. The paving system 10 may comprise a plurality of membranes 50, each of which is selectively permeable to different pollutants. The paving system 10 may comprise one or more membrane layers and one or more piping layers.

A plurality of membranes may be introduced into the paving system at separate depths. A variety of sequestering agents may be introduced proximally to each membrane. Each membrane may increase the residence time of a fluid with a sequestering agent by a differing length of time depending on the particular sequestering agent. For example, the deepest membrane layer may be more restrictive to the flow of fluid than the upper-most membrane layer. The deeper membrane layer would therefore provide a longer residence time than the upper-most membrane layer.

It will be appreciated that certain features of any of the described embodiments could be applied to other embodiments described herein.

Although the above has been described with reference to certain specific example embodiments, various modifications thereof will be apparent to those skilled in the art without departing from the scope of the claims appended hereto.

I claim:

1. A paving system for sequestering pollutants, the paving system comprising:

a pavement layer, two or more underlying layers provided beneath the pavement layer, at least one of said underlying layers comprising at least one sequestering agent for treating or removing one or more contaminants in a fluid flowing through the paving system; and a piping layer provided beneath the pavement layer;

wherein at least one of the underlying layers comprises a fluid flow restrictor adapted to restrict the flow of the fluid there-through and to increase the residence time of the fluid with the at least one sequestering agent;

and wherein the piping layer is adapted to increase or decrease the flowrate of the fluid flowing through the paving system.

2. The paving system of claim 1 wherein the fluid flow restrictor is disposed beneath at least the underlying layer comprising the at least one sequestering agent.

3. The paving system of claim 1 wherein the fluid flow restrictor comprises an impermeable membrane.

4. The paving system of claim 1 wherein the piping layer is provided between the pavement layer and the fluid flow restrictor.

5. The paving system of claim 1 wherein the pavement layer comprises a plurality of paving elements and a filler material therebetween.

6. The paving system of claim 5 wherein the fluid flow restrictor extends beyond a perimeter defined by the paving elements.

7. The paving system of claim 1 wherein the piping layer includes an overflow relief mechanism for controlling the flowrate of the fluid flowing through the paving system.

8. The paving system of claim 1 wherein at least one of the underlayers comprises a mixed aggregate.

9. The paving system of claim 8 wherein at least one of the sequestering agents is intermixed in the mixed aggregate layer.

10. The paving system of claim 5 wherein at least one of the underlayers comprises a layer of aggregate provided below the paving elements.

11. The paving system of claim 10 wherein at least one of the sequestering agents is provided in the layer of aggregate.

12. The paving system of claim 1, wherein at least one of the sequestering agents is provided in or on the piping layer.

13. The paving system of claim 1, wherein at least one of the sequestering agents is provided in or on the flow restrictor.

14. The paving system of claim 7, wherein the overflow relief mechanism comprises one or more valves.

* * * * *